US007120966B2

(12) United States Patent
Chou

(10) Patent No.: US 7,120,966 B2
(45) Date of Patent: Oct. 17, 2006

(54) ENHANCED LUGGAGE HANDLE

(75) Inventor: Ching Hui Chou, Taipei County (TW)

(73) Assignee: Chaw Khong Technology Co., Ltd., Wu Ku Hsiang (TW)

( * ) Notice: Subject to any disclaimer, the term of this patent is extended or adjusted under 35 U.S.C. 154(b) by 143 days.

(21) Appl. No.: 10/986,904

(22) Filed: Nov. 15, 2004

(65) Prior Publication Data

US 2005/0102795 A1 May 19, 2005

(30) Foreign Application Priority Data

Nov. 13, 2003 (CN) ..... 200320103283X

(51) Int. Cl.
*A45C 3/00* (2006.01)
*B25G 1/04* (2006.01)

(52) U.S. Cl. ..... 16/113.1

(58) Field of Classification Search ..... 16/113.1, 16/429, 405; 190/115, 18 A; 280/655, 655.1, 280/47.315, 47.371; 403/109.1, 377, 109.2, 403/109.3, 92–94

See application file for complete search history.

(56) References Cited

U.S. PATENT DOCUMENTS

| | | | | | |
|---|---|---|---|---|---|
| 3,998,476 | A * | 12/1976 | Kazmark, Sr. | ..... | 280/655 |
| 5,452,778 | A * | 9/1995 | Wang | ..... | 190/115 |
| 5,460,393 | A * | 10/1995 | Tsai | ..... | 280/655 |
| 5,653,000 | A * | 8/1997 | Lee | ..... | 16/113.1 |
| 5,704,725 | A * | 1/1998 | Horing | ..... | 403/109.3 |
| 5,732,443 | A * | 3/1998 | Kazmark et al. | ..... | 16/113.1 |
| 5,781,964 | A * | 7/1998 | Lin et al. | ..... | 16/113.1 |
| 6,134,749 | A * | 10/2000 | Kuo | ..... | 16/113.1 |
| 6,223,391 | B1 * | 5/2001 | Kuo | ..... | 16/113.1 |
| 6,338,586 | B1 * | 1/2002 | Kuo | ..... | 403/109.7 |
| 6,343,404 | B1 * | 2/2002 | Kuo | ..... | 16/113.1 |
| 6,470,529 | B1 * | 10/2002 | Chang | ..... | 16/113.1 |
| 6,857,512 | B1 * | 2/2005 | Scicluna et al. | ..... | 190/115 |
| 2003/0038007 | A1 * | 2/2003 | Han | ..... | 190/115 |

* cited by examiner

*Primary Examiner*—Chuck Y. Mah

(57) ABSTRACT

Provided is a retractable luggage handle in which either tube assembly thereof comprises one or more stop sleeves each secured to a top of its tube by snapping latches of the stop sleeve into apertures of the tube. A plurality of recesses are formed on either side wall of each tube and each stop sleeve by punching for adding structural strength thereto.

9 Claims, 5 Drawing Sheets

ENHANCED LUGGAGE HANDLE

BACKGROUND OF THE INVENTION

1. Field of the Invention

The present invention relates to handle of wheeled luggage and more particularly to a retractable handle with its tubes having added strength in construction.

2. Description of Related Art

A conventional U-shaped retractable handle 70 mounted on top of a wheeled luggage is shown in FIG. 1. The handle 70 comprises, at its either side, a support tube 80 and a sliding tube slidably received in the support tube 80. A stop sleeve 81 is provided on top of the support tube 80 for preventing the sliding tube from disengaging from the support tube 80 while extending the handle 70.

Currently, thickness of the handle tube is reduced to a range of 0.4 mm to 0.45 mm for saving the manufacturing cost and decreasing weight of the luggage. However, the handle 70 may vibrate strongly when a piece of luggage fully packed with bulky items is being towed on an uneven surface or towed on a stepped floor up and down operation (see arrow in FIG. 1). This may easily deform the handle tubes or cause a separation of the stop sleeve 81 from the support tube 80. Hence, a need for improvement exists.

SUMMARY OF THE INVENTION

It is an object of the present invention to provide a handle system mounted on a wheeled luggage, the handle system including two tube assemblies of rectangular section at both sides and a handle grip interconnected the tube assemblies, either tube assembly comprising a support tube having its bottom end fixedly coupled to a bottom of luggage, the support tube including, at either side wall of an upper portion thereof, a first recess and a plurality of first apertures longitudinally disposed below the first recess; a first stop sleeve including a first flange provided on its top mouth, the first flange being adapted to rest on a top of the support tube, the first stop sleeve further including, at its either side wall, a second recess proximate the first flange and a plurality of first latches disposed below the second recess, the first latches being disposed in the first apertures for securing the first stop sleeve to the support tube; and a sliding tube sub-assembly adapted to insert through the first stop sleeve into the support tube, the sliding tube sub-assembly including, at its either side wall, a recessed portion proximate its bottom mouth, wherein each of the recesses or the recessed portion is formed by punching for adding structural strength to the first stop sleeve, the support tube, or the sliding tube sub-assembly.

In one aspect of the present invention, the support tube further comprises an internal first locking device, and the sliding tube sub-assembly further comprises an outer sliding tube adapted to insert through the first stop sleeve into the support tube to be coupled to and to be locked by the first locking device, the outer sliding tube including, at its either side wall, a third recess proximate its top mouth, a plurality of second apertures longitudinally disposed below the third recess, a fourth recess proximate its bottom mouth, and an internal second locking device; a second stop sleeve including a second flange provided on its top mouth, the second flange being adapted to rest on a top of the outer sliding tube, the second stop sleeve further including, at its either side wall, a fifth recess proximate the second flange and a plurality of second latches disposed below the fifth recess; and an inner sliding tube adapted to insert through the second stop sleeve into the outer sliding tube to be coupled to and to be locked by the second locking device, the inner sliding tube including, at its either side wall, a sixth recess, wherein each of the recesses is formed by punching for adding structural strength to the second stop sleeve, the inner sliding tube, or the outer sliding tube.

In another aspect of the present invention, a rectangular third flange is provided on a top mouth of the support tube for permitting the first flange to rest thereon, and a rectangular fourth flange is provided on the top mouth of the outer sliding tube for permitting the second flange to rest thereon.

The above and other objects, features and advantages of the present invention will become apparent from the following detailed description taken with the accompanying drawings.

DETAILED DESCRIPTION OF THE PREFERRED EMBODIMENTS

Figure 1:
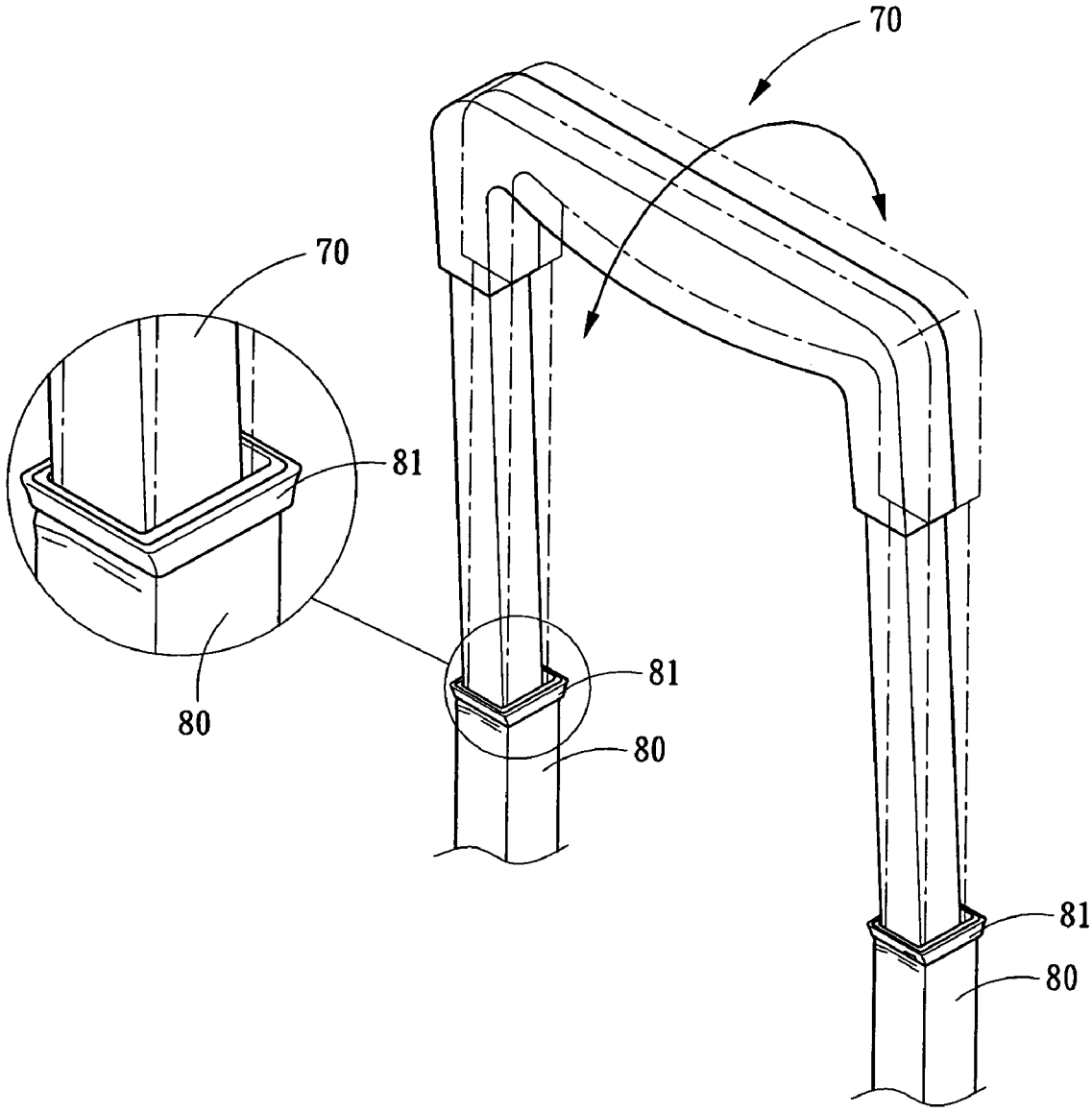
FIG. 1(Prior Art)
FIG. 1 is a perspective view of a conventional luggage handle.
Figure 2:
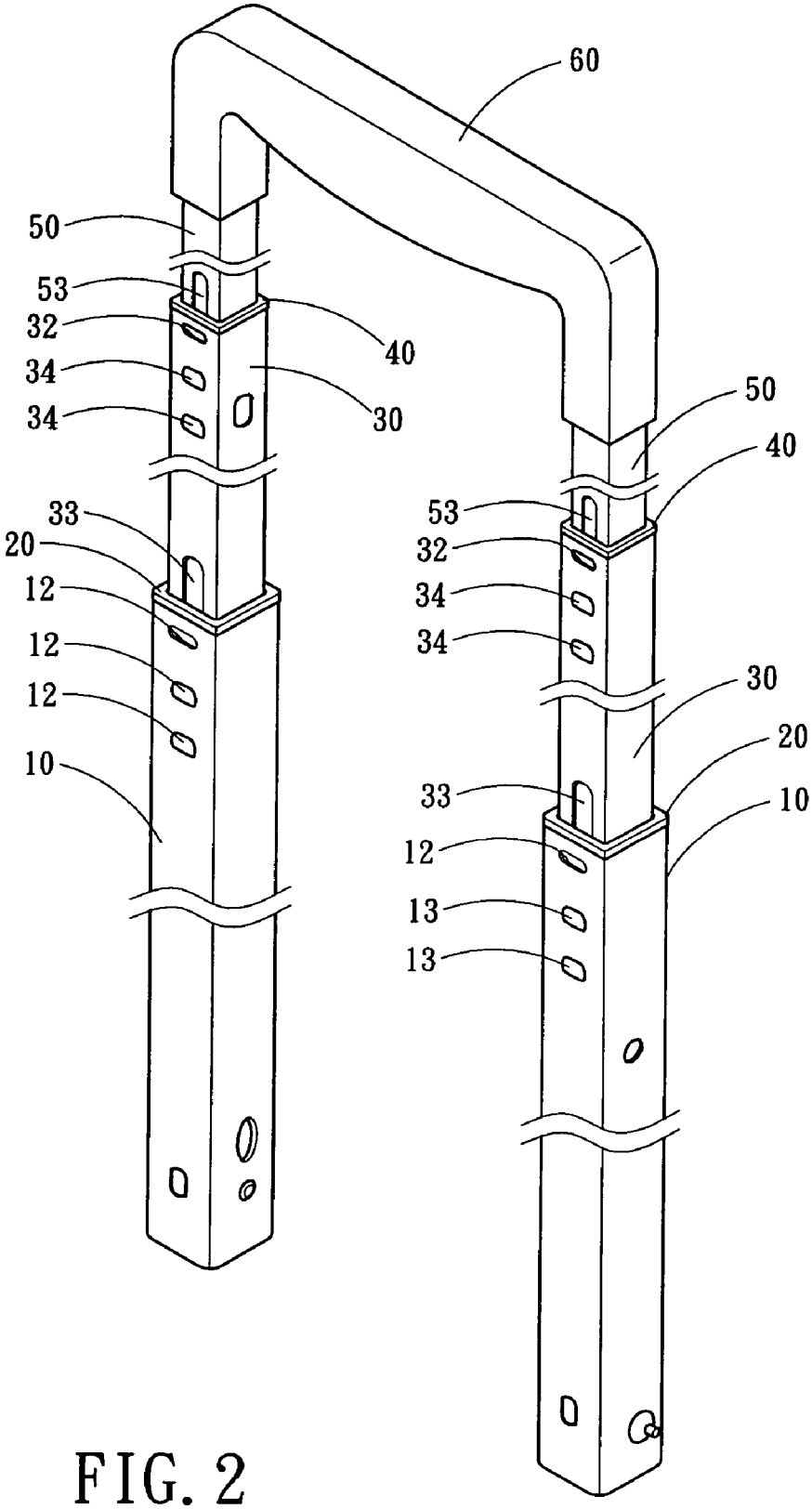
FIG. 2 is a perspective view of a first preferred embodiment of luggage handle according to the invention.
Figure 3:
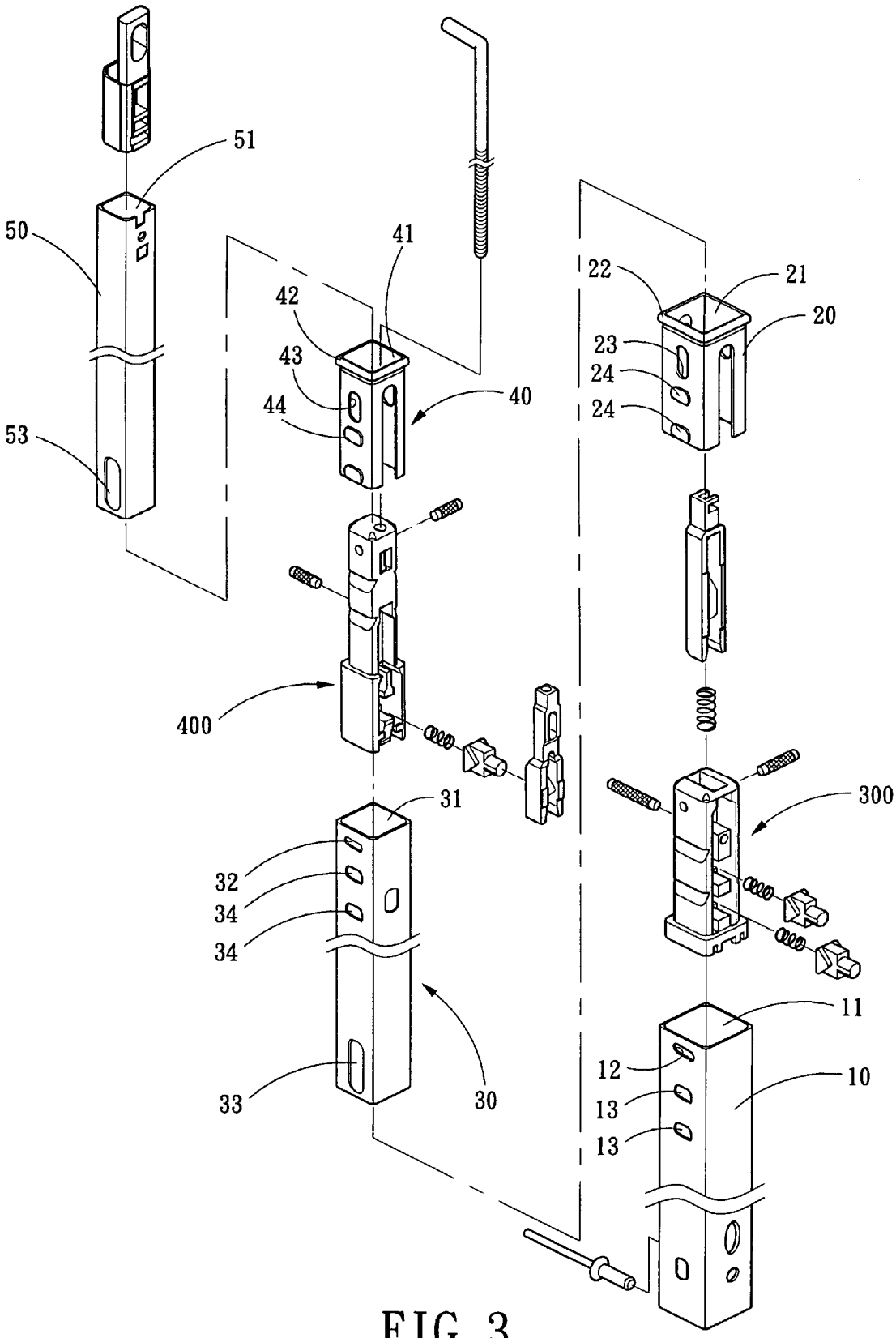
FIG. 3 is an exploded perspective view of components at either side of the handle of FIG. 2.
Figure 4:
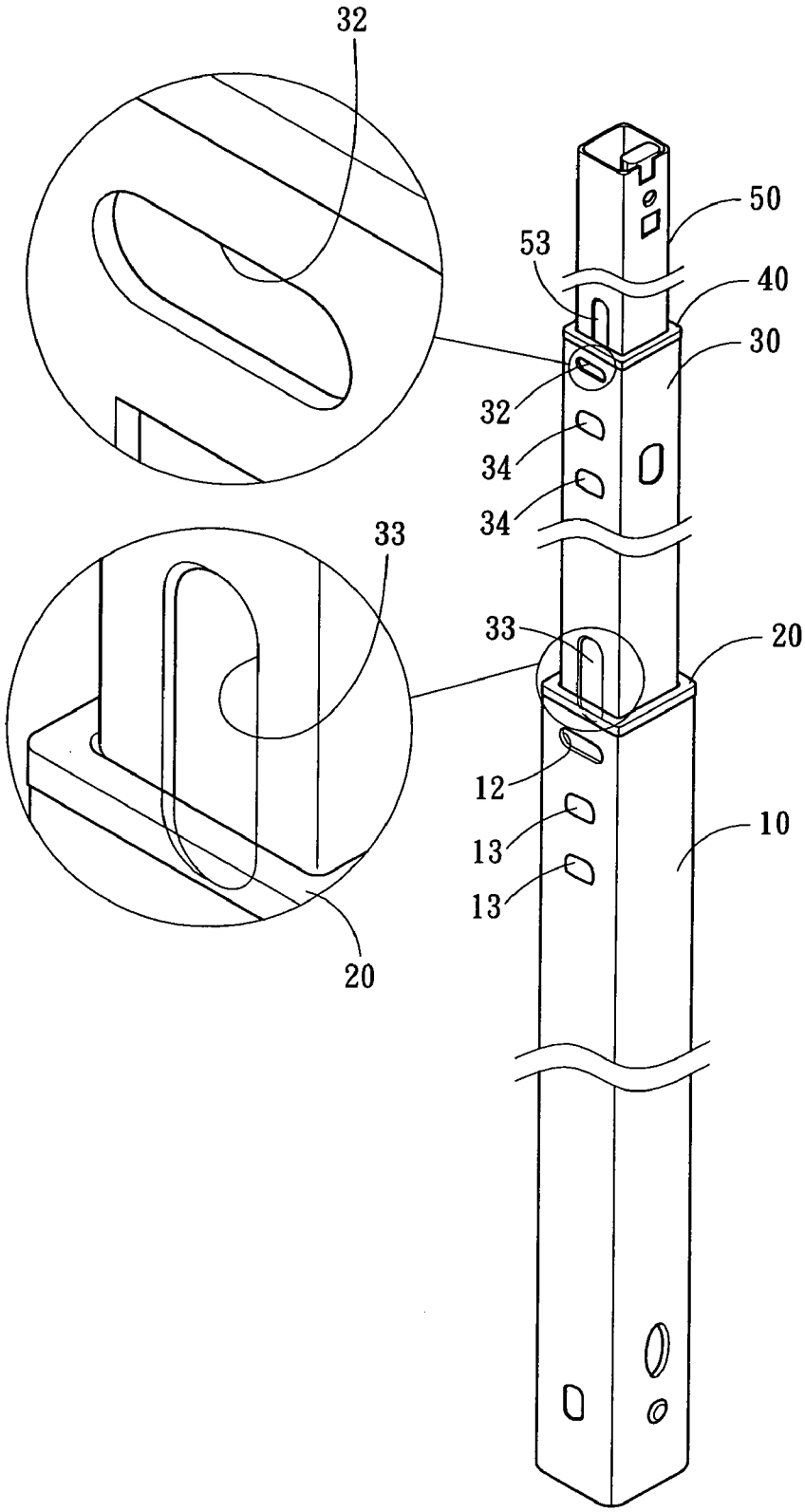
FIG. 4 is a perspective view of the assembled components of FIG. 3 where two portions are enlarged for depicting their details.

Referring to FIGS. 2, 3, and 4, there is shown a U-shaped retractable handle constructed in accordance with a first preferred embodiment of the invention. The handle comprises two identical tube assemblies at both sides and an inverted U-shaped handle grip 60 interconnected the tube assemblies. Either tube assembly of rectangular section comprising a lower support tube 10, an outer sliding tube 30, an inner sliding tube 50, and other associated components will be described in detailed below.

The support tube 10 has its bottom end fixedly coupled to a bottom of luggage. Also, either side wall of an upper portion of the support tube 10 is provided with a transverse first recess 12 proximate the mouth of a longitudinal channel 11 of the support tube 10 and two first apertures 13 longitudinally disposed below the first recess 12. A first locking device 300 is provided in the support tube 10. As locking device is a well known component in luggage handle, it will not be described in detail.

A first stop sleeve 20 is shaped to fit within an upper portion of the support tube 10 and comprises a longitudinal channel 21 and a rectangular first flange 22 provided on the top mouth of the channel 21, the first flange 22 being adapted to rest on the mouth of the channel 11 so as to position the first stop sleeve 20 in the support tube 10. Also, either side wall of the first stop sleeve 20 is provided with a longitudinal second recess 23 proximate the first flange 22 and intermediate and lower first latches 24 disposed below the second recess 23.

The outer sliding tube 30 is adapted to insert into the channels 21 and 11 to be coupled to and to be locked by the first locking device 300 when the outer sliding tube 30 is retracted or extended to a desired position in the support tube 10. Also, either side wall of an upper portion of the outer sliding tube 30 is provided with a transverse third recess 32 proximate the mouth of a longitudinal channel 31 of the outer sliding tube 30, and two second apertures 34 longitudinally disposed below the third recess 32. Moreover, either side wall of a lower portion of the outer sliding tube 30 is provided with a longitudinal fourth recess 33. A second locking device 400 is provided in the outer sliding tube 30. Again, as locking device is a well known component in luggage handle, it will not be described in detail.

A second stop sleeve 40 is shaped to fit within an upper portion of the outer sliding tube 30 and comprises a longitudinal channel 41 and a rectangular second flange 42 provided on the top mouth of the channel 41, the second flange 42 being adapted to rest on the mouth of the channel 31 so as to position the second stop sleeve 40 in the outer sliding tube 30. Also, either side wall of the second stop sleeve 40 is provided with a longitudinal fifth recess 43 proximate the second flange 42 and intermediate and lower second latches 44 disposed below the fifth recess 43.

Either side wall of a lower portion of the inner sliding tube 50 is provided with a longitudinal sixth recess 53. The inner sliding tube 50 is adapted to insert into the channels 41 and 31 to be coupled to and to be locked by the second locking device 400 when the inner sliding tube 50 is retracted or extended to a desired position in the outer sliding tube 30.

As shown in FIG. 4 specifically, in an assembled position of either tube assembly of the handle the first latches 24 are disposed in the first apertures 13 and the second latches 44 are disposed in the second apertures 34 respectively. As a result, the first and second stop sleeves 20 and 40 are secured to upper portions of the support tube 10 and the outer sliding tube 30 respectively. Moreover, each recess is formed by punching for adding structural strength to the stop sleeve or the tube having a thin thickness at a range of 0.4 mm to 0.45 mm. As an end, the handle may not vibrate strongly when the luggage fully packed with bulky items is being towed on an uneven surface or the like. That is, the handle does not tend to deform and is thus durable, reliable.

Figure 5:
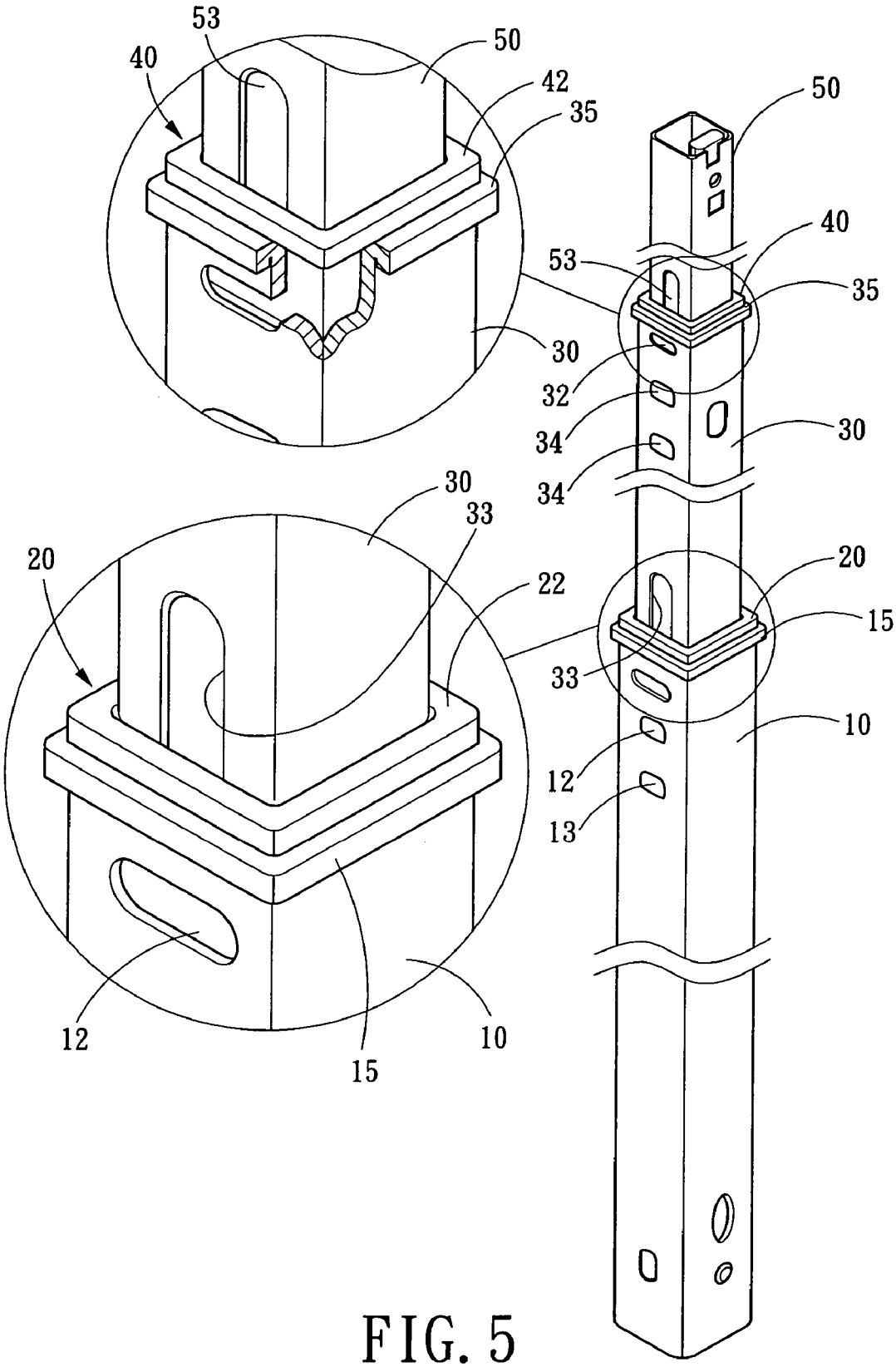
FIG. 5 is a perspective view of either side of luggage handle according to a second preferred embodiment of the invention where two portions are enlarged for depicting their details.

Referring to FIG. 5, there is shown a second preferred embodiment of the invention. The second preferred embodiment substantially has same structure as the first preferred embodiment. The differences between the first and the second preferred embodiments, i.e., the characteristics of the second preferred embodiment are detailed below. A rectangular third flange 15 is provided on the top mouth of the support tube 10. The top mouth (i.e., flange) 22 of the first stop sleeve 20 is adapted to rest on the third flange 15. Also, a rectangular fourth flange 35 is provided on the top mouth of the outer sliding tube 30. The top mouth (i.e., flange) 42 of the second stop sleeve 40 is adapted to rest on the fourth flange 35. This can enhance the securement of the first and second stop sleeves 20 and 40 to the upper portions of the support tube 10 and the outer sliding tube 30 respectively.

While the invention herein disclosed has been described by means of specific embodiments, numerous modifications and variations could be made thereto by those skilled in the art without departing from the scope and spirit of the invention set forth in the claims.

What is claimed is:

1. A handle system mounted on a wheeled luggage, the handle system including two tube assemblies of rectangular section at both sides and a handle grip interconnected the tube assemblies, either tube assembly comprising:

a support tube having its bottom end fixedly coupled to a bottom of luggage, the support tube including, at either side wall of an upper portion thereof, a first recess and a plurality of first apertures longitudinally disposed below the first recess;

a first stop sleeve including a first flange provided on its top mouth, the first flange being adapted to rest on a top of the support tube, the first stop sleeve further including, at its either side wall, a second recess proximate the first flange and a plurality of first latches disposed below the second recess, the first latches being disposed in the first apertures for securing the first stop sleeve to the support tube; and a sliding tube sub-assembly adapted to insert through the first stop sleeve into the support tube, the sliding tube sub-assembly including, at its either side wall, a recessed portion proximate its bottom mouth, wherein each of the recesses or the recessed portion is formed by punching for adding structural strength to the first stop sleeve, the support tube, or the sliding tube sub-assembly.

2. The handle system of claim 1, wherein the first recess is transverse.

3. The handle system of claim 1, wherein the second recess is longitudinal.

4. The handle system of claim 1, wherein the support tube further comprises an internal first locking device, and the sliding tube sub-assembly further comprises:

an outer sliding tube adapted to insert through the first stop sleeve into the support tube to be coupled to and to be locked by the first locking device, the outer sliding tube including, at its either side wall, a third recess proximate its top mouth, a plurality of second apertures longitudinally disposed below the third recess, a fourth recess proximate its bottom mouth, and an internal second locking device;

a second stop sleeve including a second flange provided on its top mouth, the second flange being adapted to rest on a top of the outer sliding tube, the second stop sleeve further including, at its either side wall, a fifth recess proximate the second flange and a plurality of second latches disposed below the fifth recess; and an inner sliding tube adapted to insert through the second stop sleeve into the outer sliding tube to be coupled to and to be locked by the second locking device, the inner sliding tube including, at its either side wall, a sixth recess, wherein each of the recesses is formed by punching for adding structural strength to the second stop sleeve, the inner sliding tube, or the outer sliding tube.

5. The handle system of claim 4, wherein the third recess is transverse.

6. The handle system of claim 4, wherein each of the fourth, fifth, and sixth recess is longitudinal.

7. The handle system of claim 4, further comprising a rectangular fourth flange provided on the top mouth of the outer sliding tube for permitting the second flange to rest thereon.

8. The handle system of claim 1, further comprising a rectangular third flange provided on a top mouth of the support tube for permitting the first flange to rest thereon.

9. The handle system of claim 1, wherein tube assemblies of the handle system have a rectangular section.

* * * * *